US005787506A

United States Patent [19]

Wilder et al.

[11] Patent Number: 5,787,506

[45] Date of Patent: Aug. 4, 1998

[54] HOCKEY GLOVE WITH VENTILATION HOLES

[75] Inventors: Thomas Vaughn Wilder, Laguna Niguel; Alexander Parker Reynolds, Newport Beach; Jon Garfield Wong, Long Beach, all of Calif.

[73] Assignee: Dare Development Group, Santa Ana, Calif.

[21] Appl. No.: 682,806

[22] Filed: Jul. 10, 1996

[51] Int. Cl.[6] ..... A41D 19/00

[52] U.S. Cl. ..... 2/161.1; 2/159

[58] Field of Search ..... 2/161.1, 159, 161.3, 2/161.4, 161.6, 161.8, 167, 169

[56] References Cited

U.S. PATENT DOCUMENTS

| | | | |
|---|---|---|---|
| 2,293,347 | 8/1942 | Lindfelt | 2/159 |
| 2,708,753 | 5/1955 | Kennedy | 2/159 |
| 2,831,196 | 4/1958 | Scheiber | 2/159 |
| 3,387,306 | 6/1968 | Korey | 2/159 |

FOREIGN PATENT DOCUMENTS

| | | | |
|---|---|---|---|
| 2842720 | 4/1980 | Germany | 2/161.1 |
| 2843448 | 4/1980 | Germany | 2/161.1 |
| 3135756 | 4/1983 | Germany | 2/161.1 |

*Primary Examiner*—Gloria M. Hale

*Attorney, Agent, or Firm*—Knobbe, Martens, Olson & Bear

[57] ABSTRACT

A glove for use in playing hockey is provided with ventilation holes extending through the glove to allow air to circulate directly to the skin of the hand in the glove. Segmented foam pads of the glove have cutaway sides substantially conforming to the shape of the holes. Preferably, the glove includes a floating cuff at the wrist for free yet protected movement of the wrist. Also preferably, the thumb, fingers, and palm have additional layers for reinforcement and enhanced gripping of a hockey stick.

29 Claims, 5 Drawing Sheets

HOCKEY GLOVE WITH VENTILATION HOLES

BACKGROUND OF THE INVENTION

1. Field of the Invention

The present invention relates generally to the field of protective outer gear, and, in particular, to protective gloves for use in playing roller hockey.

2. Description of the Related Art

Traditional gloves for playing hockey on ice include thick sections of foam which are arranged on the back of the glove to provide warmth and protection against hits by a hockey stick or contact with another player, the hockey puck, or the blade of an ice skate. These gloves provide protection and some flexibility of the glove to accommodate hand movements. The foam is typically covered by a material which is stitched to an inner lining, and so this type of glove requires greater time and skill for its manufacture.

Some gloves for roller hockey are less concerned with providing warmth and provide a lesser amount of padding to protect the hands during play. Roller hockey is often played in warmer climates and/or outdoors, where a warmer environment of the roller hockey game results in the player's hand sweating into the glove. This leads to discomfort by the player and may possibly impact the player's performance. Roller hockey gloves heretofore available have failed to provide adequate ventilation of the player's hands.

SUMMARY OF THE INVENTION

Accordingly, the present invention provides a hockey glove with one or more ventilation holes extending through the padded back of the glove to allow air to circulate to the skin of the back of the hand in the glove. The glove includes a ventilated palm and a protective back having a lining, foam pad segments, and an outer covering for the foam segments. The glove may also include a short, flexible cuff attached for protected movement of the wrist of the hockey player's hand.

In one embodiment of the present invention, a protective hockey glove is provided having two holes extending through the lining at the back of the glove for unobstructed air flow through the glove to the hand. Foam segments adjacent the holes have cutaway sides which form openings to accommodate such airflow. The shape of the holes may be lenticular or oval, or may have any other shape. Further, the foam segments may be formed by waffle-type foam sections. Preferably, finger gussets and the ventilated palm of the glove, at the lower palm and crease areas, have additional layers for reinforcement and enhanced gripping of a hockey stick. Optional mesh material is provided between the finger gussets and at a thumb member for air flow at the web portions of these digits. The thumb member of the glove has a pocket for alternative placement of the player's thumb and has a separate abrasion resisting layer of material on its palm side. The additional layers provide more even wear of the glove and add to its life.

The glove also preferably has a wart, or side section on the back between the thumb member and the index finger, which has a hole formed between a pair of foam segments. Thus, additional, cooling air flow is provided around the skater's hand.

In another embodiment of the present invention, a protective hockey glove is provided having a cuff attached at the palm and back of the glove using a segment of neoprene material. This provides enhanced flexibility at the wrist of the player. A padded cuff roll is attached at the junction of the cuff to the body of the glove. The cuff is split into three sections to accommodate sideways movement of the player's wrist. Two adjacent sections at the glove's back slightly overlap to ensure protection around the wrist without a vulnerable gap. The top or back section of the cuff is configured to curve slightly upwardly, away from the player's wrist, to accommodate backward flexing of the hand. The cuff below the thumb and the palm forms curved or radially cut edges toward the back section, such that the cuff is narrower below the palm of the glove and therefore accommodates forward bending of the player's hand at the wrist. Thus, this "floating cuff" provides enhanced performance characteristics for the player.

These and other advantages and applications will become apparent to those skilled in the art from the following detailed description of the preferred embodiments and the drawings referenced herein, the inventions not being limited to any particular embodiment disclosed herein.

DETAILED DESCRIPTION OF THE PREFERRED EMBODIMENT

Figure 1:
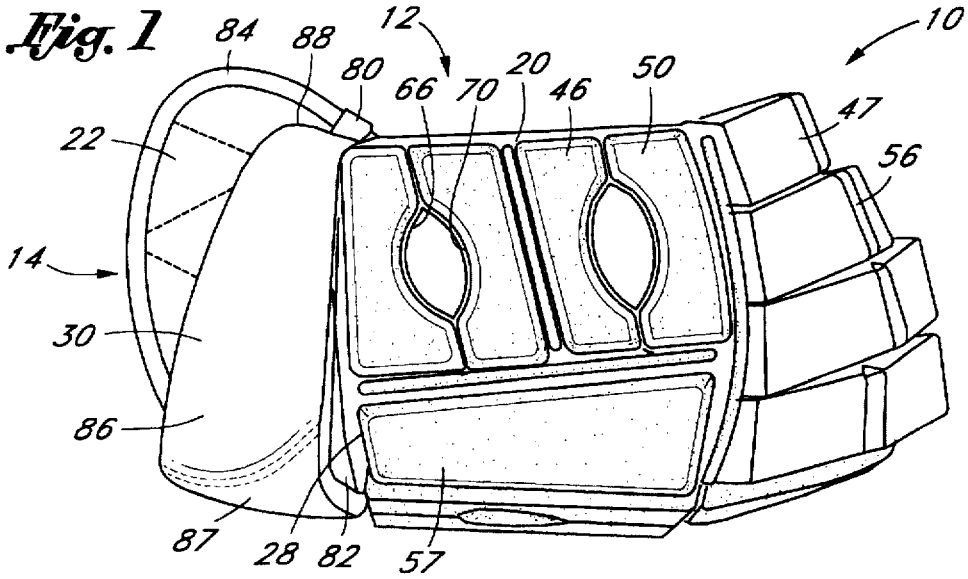
FIG. 1 is a top plan or back view of a left hand protective glove having features in accordance with the present invention.

FIG. 1 shows a roller hockey glove 10 having features in accordance with the present invention. The glove 10 generally comprises a body 12 and a cuff 14. The body 12 has a palm portion 16, finger gussets 18, and a back 20. The cuff 14 has panels 22, 24, 26 attached to a lower edge 28 of the body 12 and a cuff roll 30 extending below the back 20 of the glove body 12.

The palm portion 16 of the body 12 extends to cover the fronts of the thumb and fingers of the hockey wearer's hand. A plurality of holes 32 are provided in the palm portion 16 for allowing ventilation of the wearer's palm, thumb and fingers. The palm portion 16 of the glove 10 may be formed, for example, of split leather or synthetic leather selected for durability and comfort. Preferably, gripping sections 34, 36 of material, such as textured synthetic leather, is provided at a crease portion of the palm side and also at about the middle joint of the front of the middle two fingers of the glove 10 to improve gripping ability. If desired, the crease portion of the palm may have a layer of tacky material for enhanced gripping. A reinforcing section of material is preferably provided at a heel or lower portion of the palm side of the glove, and this may be formed as an extension of the gripping material at the crease portion, as shown in FIG. 3.

The front of a thumb member 38 of the glove 10 has a loop 39 formed at the palm side to create a pocket for alternative placement of the wearer's thumb. Web or lower connecting portions 40 of the finger gussets 18 and an inside 42 of the thumb loop 39 are preferably formed of a mesh material to allow air to freely circulate to the thumb and fingers of the wearer's hand. The finger gussets 18 are preferably formed of leather or other natural or synthetic material selected for softness and durability and also include holes 32 for ventilation. It is preferred to provide tabs 44 of split leather over the tips of the finger gussets 18 for greater abrasion resistance, improved gripping ability, and extended wear of the glove 10. Preferably, at least the middle two finger gussets include a tacky material attached at a lower portion for enhanced gripping.

Figure 6:
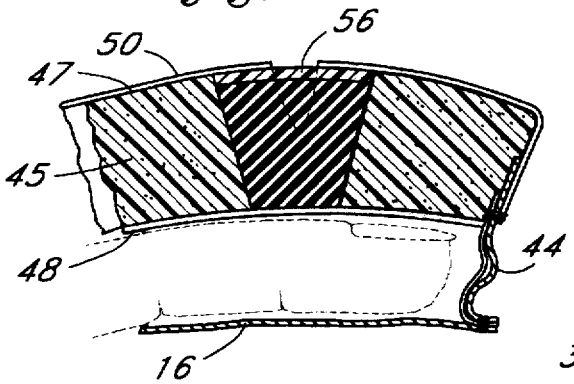
FIG. 6 is a cross-sectional view taken along lines 6—6 of FIG. 5.
Figure 8:
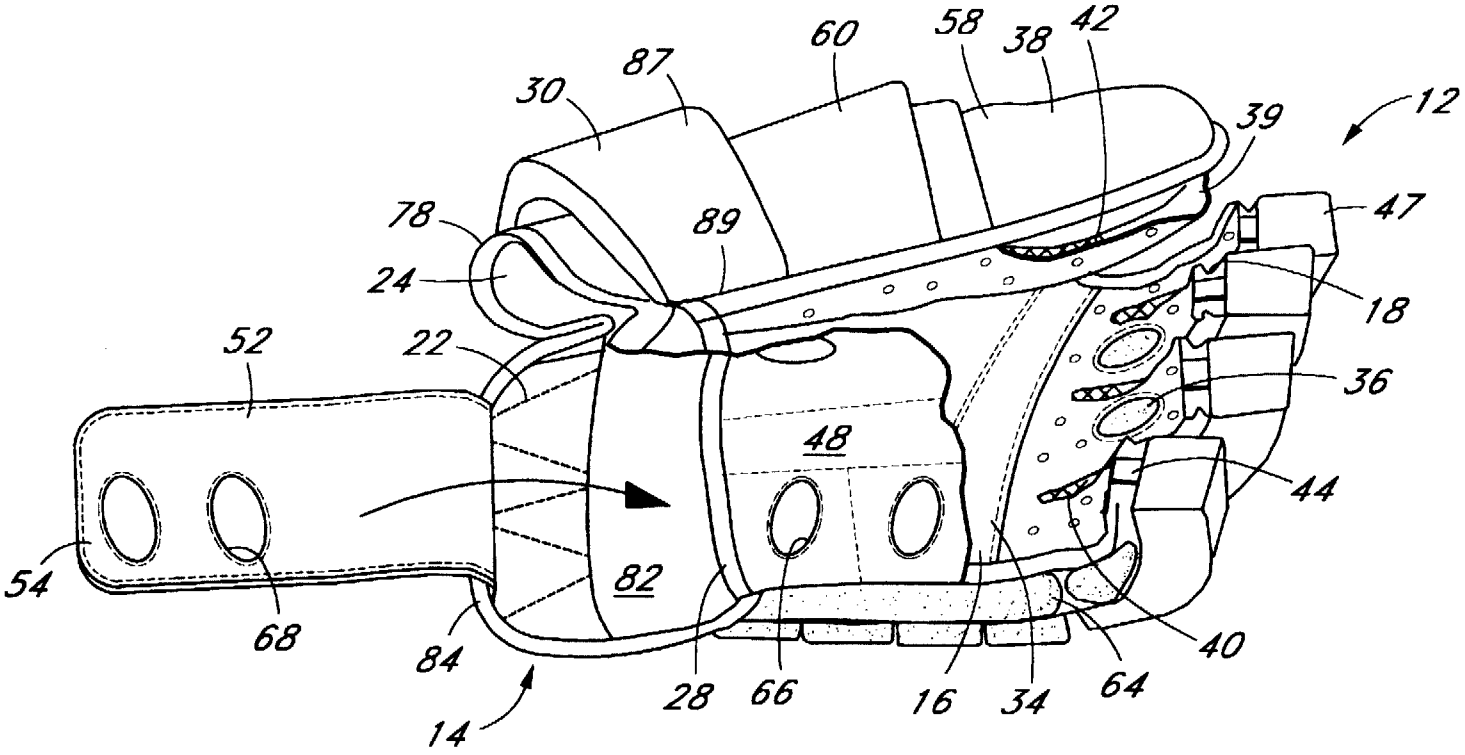
FIG. 8 is a partial cutaway view of the palm side of the glove of FIG. 1, showing its loose pad pulled out.

Referring to FIGS. 6 and 8, the back 20 of the glove, including the backs of the fingers 18, includes segments 46, 47 formed of relatively thick foam sandwiched between an inner liner 48 and an outer cover 50. These segments 46, 47 may be formed by waffle-type foam material, as known to those skilled in the art. The inner liner 48 is typically about ⅛ inch foam covered on both sides by nylon. The foam segments 46, 47 are preferably between about ¼ to one inch thick for providing adequate protection of the hand. Preferably, the outer cover 50 is leather, or a suitable synthetic material, such as woven nylon cordura.

Figure 3:
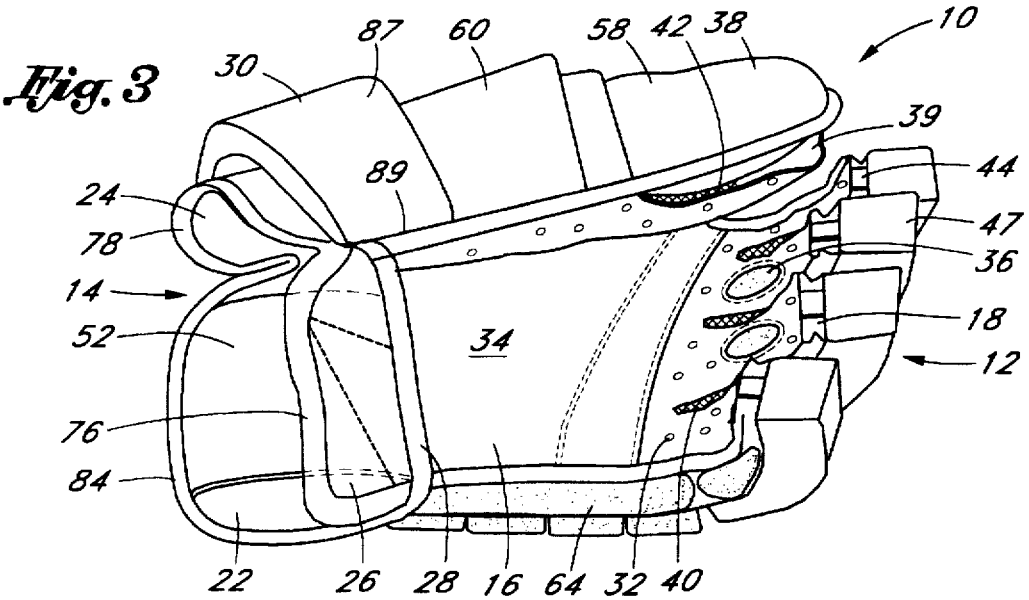
FIG. 3 is a bottom plan or palm view of the glove of FIG. 1.

As shown in FIGS. 3 and 8, a loose pad 52 of substantially rectangular shape is preferably attached to the lower edge of the back of the cuff 14, as described below. This pad 52 is similar to the inner liner 48, comprising about ⅛ to ½ inch layer of foam covered by nylon and provides additional comfort for the wearer. A free end 54 of the pad 52 extends to just below the finger gussets 18 when it is full inserted into the glove 10.

Figure 2:
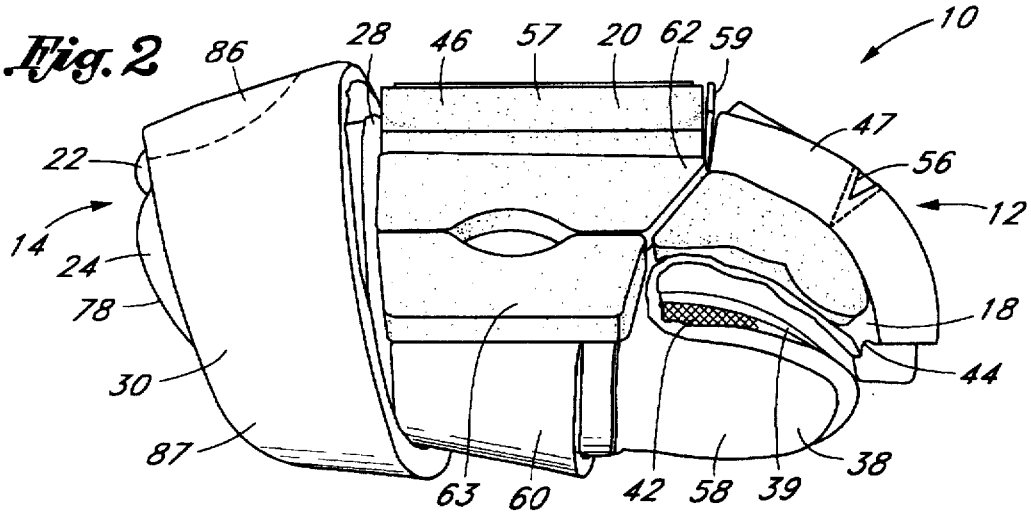
FIG. 2 is a right side elevational view of the glove of FIG. 1.
Figure 5:
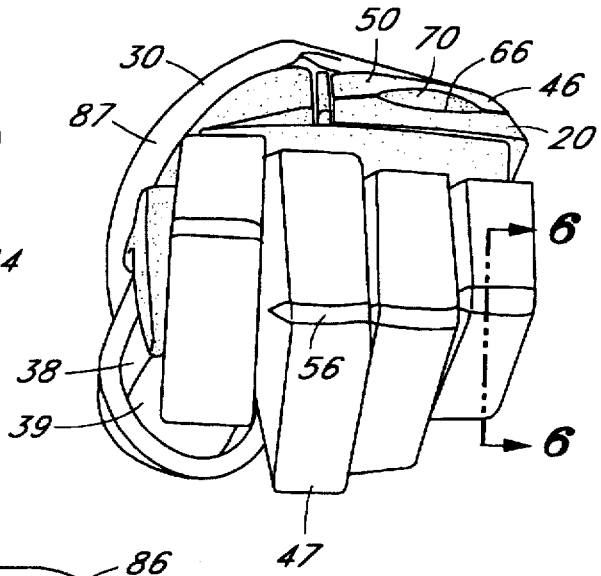
FIG. 5 is a finger end elevational view of the glove of FIG. 1.

The foam segments 46, 47 of the back 20 are formed and grouped to substantially conform to the shape of the back of the hand and fingers of a wearer. These foam segments 46, 47 are generally rectangular in cross-section. Referring to FIGS. 5 and 6, the finger segments 47 are preferably formed to curve slightly to imitate a slightly closed position of the wearer's hand, and its outer cover 50 preferably includes a split center section 56 to accommodate the curvature. As shown in FIGS. 1 and 2, a decorative foam segment 57 may be included between the lateral segments and a thumb member of the glove, and decorative panels 59 may be included between any of the foam segments 46, 47, 57 of the glove 10.

The thumb member 38 preferably comprises upper and lower substantially rigid portions 58, 60. These portions 58, 60 are curved to more closely fit partially around and protect the wearer's thumb. The upper portion 58 does not require a foam segment, and the lower portion 60 preferably includes a thinner foam segment than are used for the back and fingers segments 46, 47 of the glove 10.

Referring to FIG. 2, additional foam segments may be provided at the side of the glove between the index finger and thumb. This is often referred to as a "wart". Preferably, a foam segment 62 extends along the side of the hand at least partially up the index finger, and a shorter, adjacent foam segment 63 extends along the side of thumb member 38 up to its web 42. Referring to FIG. 3, one or more thinner foam segments 64 may optionally be provided along the outside of the pinky, between the back 20 and palm 16 of the glove 10.

In this preferred embodiment of the glove shown in FIGS. 1 and 8, a pair of openings 66 are provided between adjacent foam segments 46 on the back 20 of the glove 10. These openings 66 preferably extend to the glove interior, exposing the wearer's skin; although, in alternative embodiments, a thin, interior layer of nylon or the like (not shown) may cover these openings 66 on the inside of the glove. It is most preferred, however, that these openings be unobstructed to allow direct contact of air with the skin of the wearer's hand. In addition, the loose pad 52 includes corresponding holes 68 to maintain protection and ventilation of the hand.

It is understood that in the present invention a single opening 66, or three or more openings, may alternatively be provided on the glove 10 for airflow therethrough. These openings 66 may have any shape, such as the lenticular or oval shape shown, or may be circular or polygonal, for example. The openings 66 are sized in accordance with the glove size to provide adequate air circulation to the hand without compromising the level of protection of the hand against contact by a hockey puck or stick. To accommodate the openings 66, the foam segments 46 on the back 20 have cutaway sides 70 which correspond to the shape of the openings 66. The wart foam segments 62, 63 also have cutaway sides 72 to accommodate an additional opening 74 at that location.

In the preferred embodiment of the present invention shown in FIGS. 1–8, the cuff 14 of the glove 10 comprises three panels 22, 24, 26 attached to the lower edge 28 of the body 12 and the cuff roll 30 extends about two-thirds the distance around the cuff 14. The panels 22, 24, 26 are padded for protection about the wearer's wrist, but are preferably less than about half as thick as the foam segments 46, 47 on the body 12 of the glove 10. The panels 22, 24, 26 are preferably covered by leather or suitable synthetic materials such as woven nylon cordura, as desired. Optionally, a fairly rigid member (not shown) may be included in one or more panels for added protection of the wearer's wrist against hits from a hockey stick or the puck.

It is preferred that the back panel 22 of the cuff 14, generally below the fingers 18 of the glove 10, be formed to curve slightly outward at its free edge 84 (FIG. 7), away from the back of the wearer's hand. This provides greater freedom for the wearer to flex his or her hand during play without bending the glove 10 and creasing the material. Referring to FIGS. 2 and 3, in order to accommodate sideways motion of the wearer's hand, especially at the thumb side, it is preferred that the palm panel 26 include a free edge 76 which is radially cut so that the palm panel 26 is wider below the pinky and narrower closer to the thumb. Similarly, the panel 24 substantially below the thumb is preferably radially cut along its free edge 78 so that it has about the same narrow width adjacent the palm panel 26 and is wider toward the back panel 22 of the glove 10. The thumb and palm panels 24, 26 may be separately formed and attached to the glove body, as shown in FIG. 3, or they may alternatively be integrally formed and attached as a single panel to the glove.

Figure 4:
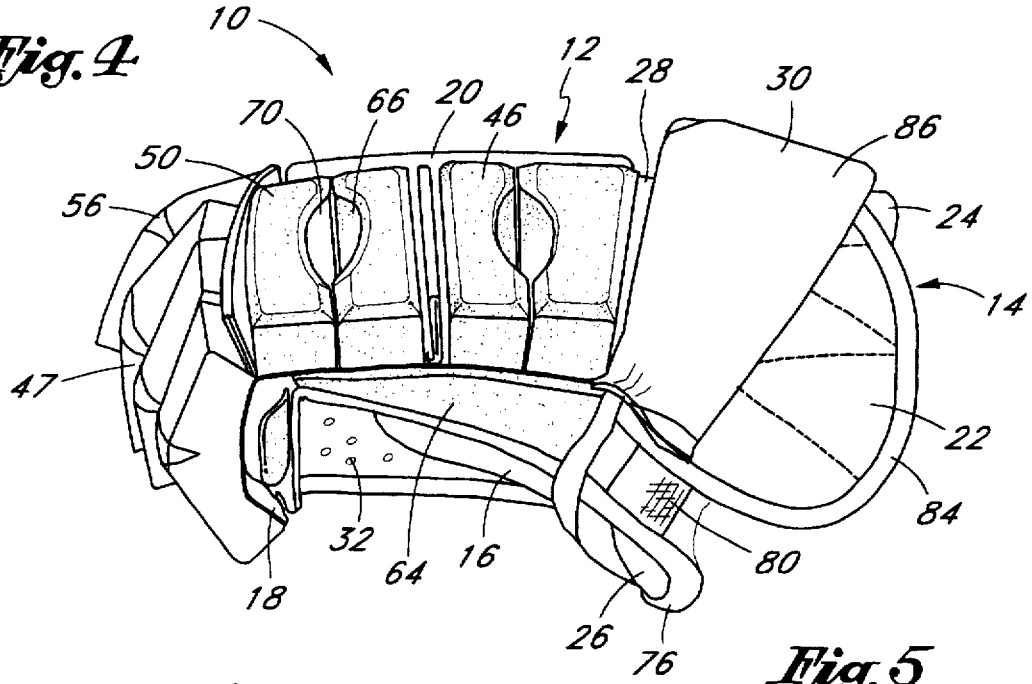
FIG. 4 is a left side elevational view of the glove of FIG. 1.

As shown in FIG. 3 and 4, a discontinuity in the adjacent panel widths occurs at the junction of the back panel 22 with the palm panel 26 of the cuff 14. Preferably, a short strip of elastic 80 is provided between the back and palm panels 22, 26 to maintain their proximity during use, so that one or both does not become deformed and separate enough to allow a stick or such to strike the wearer's wrist. It is preferred that adjoining panels 22, 24, 26 of the cuff 14 overlap slightly to further safeguard against openings around the wrist which could lead to injury.

In this embodiment of the present invention, the back and thumb panels 22, 24 of the cuff 14 are attached to the body 12 of the glove 10 using sections 82 of compliant material, preferably neoprene. In this particular embodiment, the loose pad 52 is attached at a free edge 84 of the back panel 22, rather than to the body 12 of the glove 10. This flexible or "floating" cuff 14 allows enhanced flexibility of the glove for the wearer's hand motions, such as when hitting the hockey puck with the stick.

Figure 7:
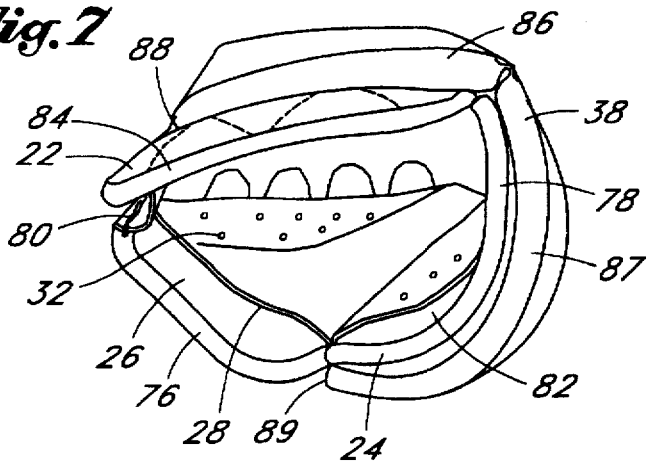
FIG. 7 is a palm end elevational view of the glove of FIG. 1.

Referring to FIG. 7, the cuff roll 30 is formed of sections formed of foam about ½ inch thick which are covered by real or synthetic leather, or other suitable material. In this embodiment, the cuff roll 30 comprises separate foam sections 86, 87 generally corresponding in length to the back and thumb panels 22, 24 of the cuff. The cuff roll 30 is preferably attached only at its short ends 88, 89 near either side of the palm panel 26.

In a protective glove constructed in accordance with the present invention, a variety of arrangements of the foam segments for the back of the glove are possible. As shown in the alternative embodiment 100 of FIGS. 9–12, a back 120 of the glove 100 may have a group of about three segments 146 extending laterally across the back from under its pinky or little finger segment 147 toward its thumb member 138. Openings 166 are formed between adjacent segments 146, extending through the glove 100 to its interior. A foam segment 162 extends along the side of the hand, or wart, up along the index finger, and a shorter, adjacent foam segment 163 extends along the side of thumb member 138 up to its web 142. Another opening 174 is provided in the wart of the glove 100.

Figure 9:
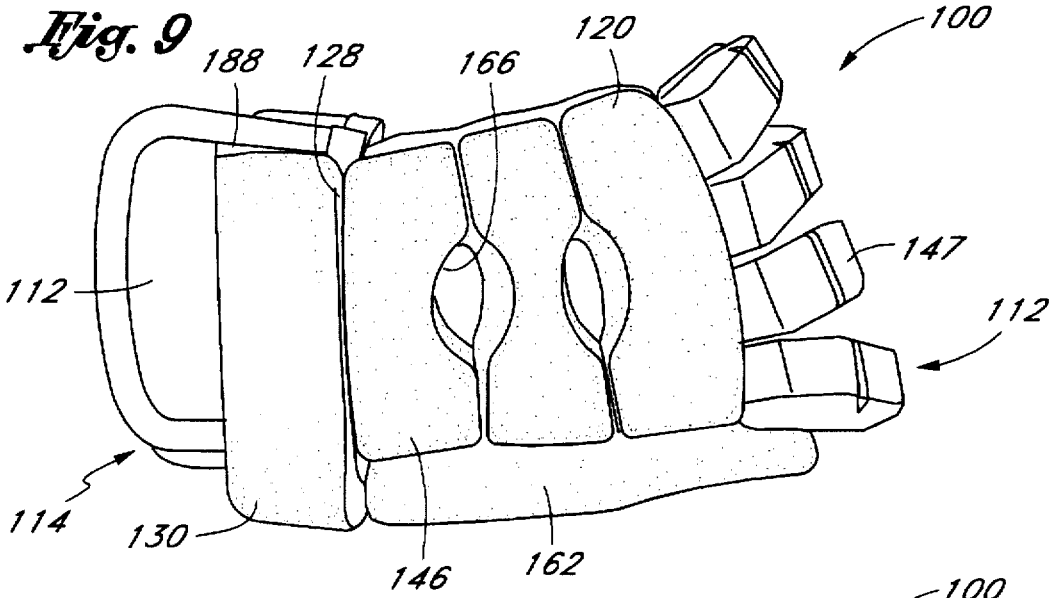
FIG. 9 is a top plan or back view of an alternative embodiment of a left hand protective glove having features in accordance with the present invention.
Figure 10:
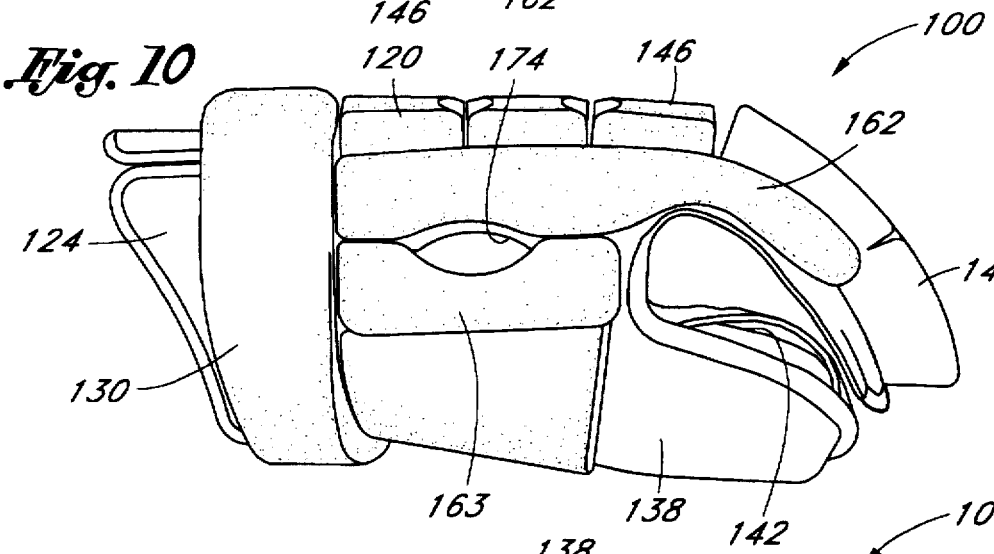
FIG. 10 is a right side elevational view of the glove of FIG. 9.
Figure 11:
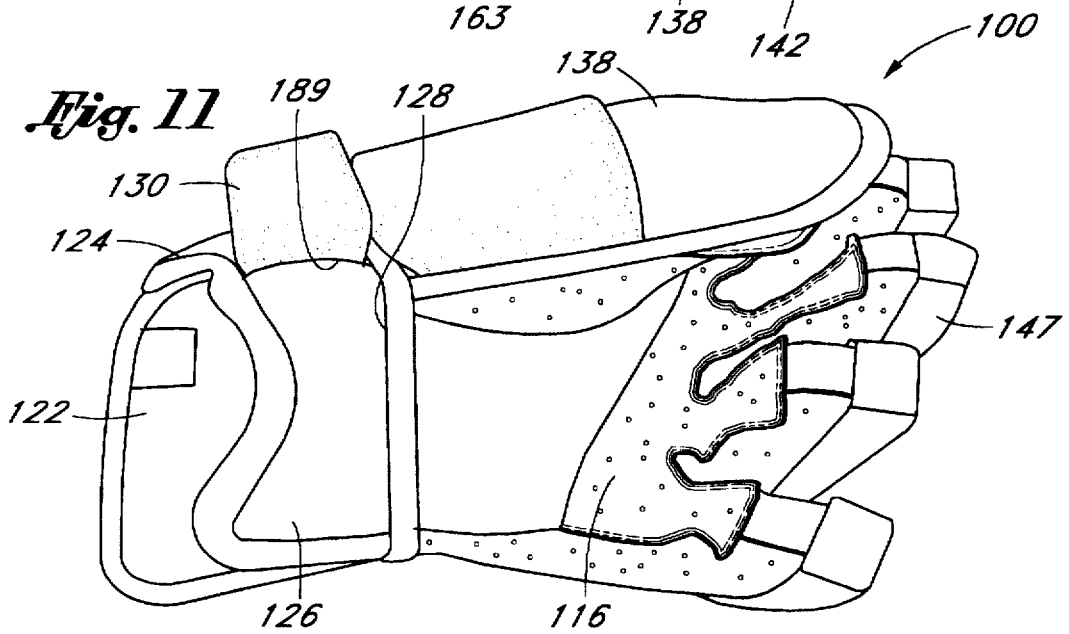
FIG. 11 is a bottom plan or palm view of the glove of FIG. 9.
Figure 12:
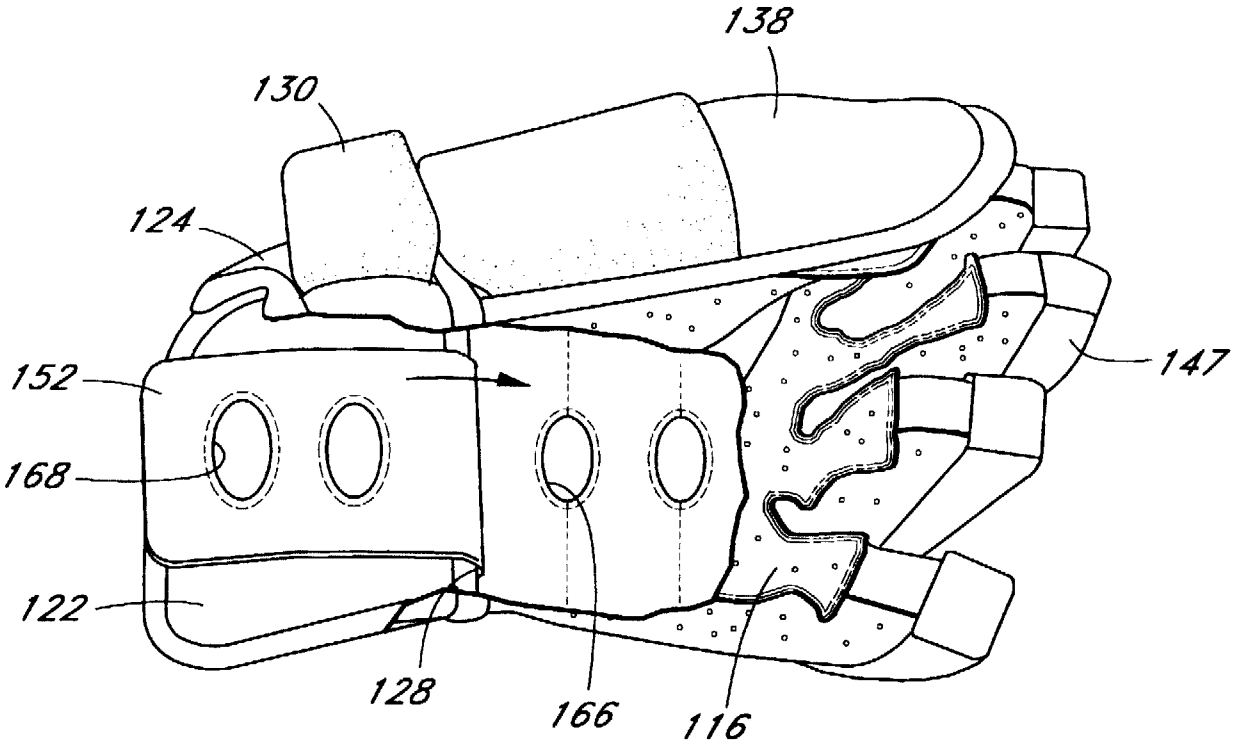
FIG. 12 is a partial cutaway view of the palm side of the glove of FIG. 9, showing its loose pad pulled out.

In this embodiment, a cuff 114 has a cuff roll 130 is sewn along one edge to a lower edge 128 of the glove body 112. In addition, panels 122, 124, 126 are also attached to the lower edge 128. In addition, the cuff roll 130 may be attached at its short ends 188, 189 near each side of the panel below a palm portion 116 of the glove 100, as shown in FIGS. 9 and 11. An interior pad 152 (FIG. 12) of substantially rectangular shape is also preferably attached at the lower edge 128 of the back 120, and has holes 168 corresponding to those 166 on the back 120 of the glove 100.

The embodiments of the glove of the present invention illustrated and described above are provided by way of example only. Changes and modifications may be made from the embodiments presented herein by those skilled in the art without departure from the spirit and scope of the invention herein disclosed, as defined by the appended claims.

What is claimed is:

1. A protective hockey glove, comprising:

a palm;

a protective back extending over said palm, said back having a plurality of foam segments sandwiched between an inner lining and an outer covering; and at least one opening formed between adjacent foam segments and extending completely through said covering and said inner lining to allow direct air contact with and ventilation of a hand disposed in said glove;

wherein said opening provides a flow of air for cooling and evaporation of sweat.

2. The glove of claim 1, wherein said foam segments are formed from waffle-type foam material.

3. The glove of claim 1, wherein said opening further extends through said lining of said back of said glove thereby providing unobstructed air flow through said glove.

4. The glove of claim 1, further including a wart portion of said back extending between said thumb member and the index finger, said wart having a pair of foam segments with an opening therebetween extending at least through said covering at said wart portion.

5. The glove of claim 1, comprising at least two openings formed in said back of said glove.

6. The glove of claim 1, wherein said adjacent foam segments at said opening have sides cut-away to accommodate said opening.

7. The glove of claim 6, wherein said cut-away sides of said adjacent foam segments and said opening form a generally lenticular shape.

8. The glove of claim 1, wherein at least the middle two of said finger gussets include a tacky material attached at a lower portion for enhanced gripping.

9. The glove of claim 1, wherein a crease portion of said palm has a layer of tacky material for enhanced gripping.

10. The glove of claim 1, further comprising an inner pad having at least one hole corresponding to said at least one opening.

11. The glove of claim 1, wherein said cuff is attached using a compliant material.

12. A protective hockey glove, comprising:

a palm;

a protective back extending over said palm;

a cuff flexibly attached to said palm and said back using a segment of compliant material; and a cuff roll extending over said cuff except below said palm of said glove;

whereby said cuff provides comfort and protection of the wrist of a wearer.

13. The glove of claim 12, wherein said compliant material comprises neoprene.

14. The glove of claim 12, wherein said cuff is split into three hinged sections having two adjacent sections overlapping slightly.

15. The glove of claim 12, wherein said cuff has a precurved top for backward movement of the hand of said player.

16. The glove of claim 12, wherein said cuff has a radial cut below said thumb member.

17. The glove of claim 12, wherein said cuff has a radial cut below said palm.

18. A protective hockey glove, comprising:

a palm;

a protective back extending over said palm, said back having a plurality of foam segments sandwiched between an inner lining and an outer covering; and at least one opening formed between adjacent foam segments extending through said covering to allow ventilation of a hand disposed in said glove, wherein said opening provides a flow of air for cooling and evaporation of sweat; and, a wart portion of said back extending from between said thumb member and the index finger, said wart portion having a pair of foam segments with an opening therebetween extending at least through said covering at said wart portion.

19. The glove of claim 18, wherein said foam segments are formed from waffle-type foam material.

20. The glove of claim 18, wherein said opening further extends through said lining of said back of said glove thereby providing unobstructed air flow through said glove.

21. The glove of claim 18, comprising at least two openings formed in said back of said glove.

22. The glove of claim 18, wherein at least the middle two of said finger gussets include a tacky material attached at a lower portion for enhanced gripping.

23. The glove of claim 18, herein a crease portion of said palm has a layer of tacky material for enhanced gripping.

24. The glove of claim 18, further comprising an inner pad having at least one hole corresponding to said at least one opening.

25. The glove of claim 18, wherein said cuff is attached using a compliant material.

26. A protective hockey glove, comprising:

a palm;

a protective back extending over said palm, said back having a plurality of foam segments sandwiched between an inner lining and an outer covering; and at least one opening formed between adjacent foam segments extending through said covering and said inner lining to allow direct air contact with and ventilation of a hand disposed in said glove;

wherein said adjacent foam segments at said opening have sides cut-away to provide a flow of air for cooling and evaporation of sweat.

27. The glove of claim 26, wherein said cut-away sides of said adjacent foam segments and said opening form a generally lenticular shape.

28. A protective hockey glove, comprising:

a palm;

a protective back extending over said palm;

a cuff flexibly attached to said palm and said back using a segment of compliant neoprene material;

whereby said cuff provides comfort and protection of the wrist of a wearer.

29. A protective hockey glove, comprising:

a palm;

a protective back extending over said palm; and a cuff flexibly attached to said palm and said back using a segment of compliant material, said cuff being split into three hinged sections having two adjacent sections overlapping slightly;

whereby said cuff provides comfort and protection of the wrist of a wearer.

* * * * *